US007051382B2

(12) United States Patent
Haberkorn

(10) Patent No.: US 7,051,382 B2
(45) Date of Patent: May 30, 2006

(54) SANITARY CLEANSING APPARATUS AND PROCESS

(76) Inventor: Wilhelm Andreas Haberkorn, 4 Painted Bunting La., Savannah, GA (US) 31411-3026

( * ) Notice: Subject to any disclaimer, the term of this patent is extended or adjusted under 35 U.S.C. 154(b) by 0 days.

(21) Appl. No.: 10/707,910

(22) Filed: Jan. 23, 2004

(65) Prior Publication Data

US 2004/0205884 A1 Oct. 21, 2004

Related U.S. Application Data

(62) Division of application No. 10/065,732, filed on Nov. 13, 2002, now Pat. No. 6,754,913.

(51) Int. Cl.
*E03D 9/08* (2006.01)

(52) U.S. Cl. ..... 4/420.4

(58) Field of Classification Search ..... 4/420.2, 4/420.4

See application file for complete search history.

(56) References Cited

U.S. PATENT DOCUMENTS

| | | | | |
|---|---|---|---|---|
| 4,406,025 | A * | 9/1983 | Huck et al. | 4/443 |
| 6,754,913 | B1 * | 6/2004 | Haberkorn | 4/420.4 |
| 2003/0084506 | A1 | 5/2003 | Haberkorn | 4/662 |

* cited by examiner

*Primary Examiner*—Charles E. Phillips

(57) ABSTRACT

A posterior part sanitary cleansing apparatus is provided for attachment to conventional toilets to facilitate posterior part cleansing with a cleaning fluid after use of the toilet. The embodiment of this invention utilizes an external cold water source and an external housing containing pump, heater and anti-siphon valve and sufficient free volume for cleaning fluid. A cleaning nozzle is mounted within the confines of a conventional toilet bowl. The cleaning nozzle creates a diffusing stream of cleaning fluid directed toward a projected cleaning space located within the confines of the toilet bowl. A disinfectant and deodorizing fluid is deposited onto the outer nozzle surfaces after every use to positively ensure sanitary conditions. The preferred range of the cleaning fluid flow is from 10 to 50 milliliters per second at a temperature range from 25° C. to 50° C. The cleaning fluid can consist of water only, water mixed with soap, water mixed with anti-bactericide, water mixed with anti-smelling agents and/or any combination thereof.

60 Claims, 2 Drawing Sheets

SANITARY CLEANSING APPARATUS AND PROCESS

CROSS REFERENCE To RELATED APPLICATIONS

This application is a divisional of application Ser. No. 10/065,732, filed Nov. 13, 2002, now U.S. Pat. No. 6,754,913.

BACKGROUND OF INVENTION

Complex patents: A number of relevant patents have been issued over the years that contain very complex and sophisticated mechanisms and control schemas; which results in a high cost of manufacture. Those patents result in commercial products that demand a premium price from consumers. Thus, its commercial market appeal is limited, particularly, within the US market. Historical low market penetrations substantiate the aforementioned statements. The applicable patents are:

Complex Patents

| Patent Number | Inventor | Patent Number | Inventor |
|---|---|---|---|
| 6,167,577 | Hammad | 4,704,748 | Takeda et al. |
| 6,105,178 | Kurisaki et al. | 4,628,548 | Kuosawa et al. |
| 5,953,766 | Szoke | 4,581,779 | Matsui et al. |
| 5,953,765 | Hayashi et al. | 4,553,274 | Yui |
| 5,898,956 | Kurisaki et al. | 4,551,868 | Kawai et al. |
| 5,884,345 | Sugiyama | 4,581,779 | Matsui et al. |
| 5,839,129 | Lee | 4,558,473 | Morikawa et al. |
| 5,826,282 | Matsumoto et al. | 4,553,274 | Yui |
| 5,765,238 | Furukawa et al. | 4,451,942 | Hirano et al. |
| 5,369,817 | Iguchi | 4,551,868 | Kawai et al. |
| 5,319,811 | Hauri | 4,550,454 | Yui |
| 5,279,001 | Vento | 4,406,025 | Huck et al. |
| 5,208,922 | Machinaga et al. | 4,393,525 | Kondo |
| 5,206,928 | Sporri | 4,391,004 | Kawai et al. |
| 5,203,037 | Kang | 4,389,738 | Ando et al. |
| 5,050,249 | Takeda et al. | 4,370,764 | Ando et al. |
| 4,987,617 | Furukawa et al. | 4,340,980 | Fushimi et al. |
| 4,980,933 | Tsutsui et al. | 4,304,016 | Oguma et al. |
| 4,841,582 | Matsui et al. | 3,995,326 | Umann |
| 4,829,606 | Hirashiba et al. | 3,430,267 | Van Houten |
| 4,807,311 | Ingels | 3,247,527 | Umann |
| 4,761,837 | Takeda | 2,875,450 | Umann |
| | | 2,872,687 | Maurer |

Simple mechanical patents: A number of relevant patents were issued over the years that fundamentally contain simple mechanisms and control schemas, which result in low cost of manufacture. Those patents result in commercial products that demand a low market price from consumers. Due to a variety of reasons, such commercial products, however, have failed to generate widespread market appeal and market penetration within the US market. The applicable patents are:

Simple Mechanical Patents

| Patent Number | Inventor | Patent Number | Inventor |
|---|---|---|---|
| 6,339,852 | Huang | 4,242,764 | Fukuda |
| 6,192,527 | Paul | 4,181,985 | Rius |
| 6,178,568 | Boulieris | 4,127,904 | Junker |
| 6,105,179 | Burns | 4,094,018 | Bemthin |
| 5,987,660 | Wang | 4,068,325 | Bemthin |

-continued

Simple Mechanical Patents

| Patent Number | Inventor | Patent Number | Inventor |
|---|---|---|---|
| 5,933,881 | Smith | 4,014,355 | DiMatteo |
| 5,799,341 | Rodas | 3,914,804 | Schrader et al. |
| 5,754,988 | Presa | 3,810,260 | Lodl |
| 5,659,901 | Derakhsan | 3,570,015 | Rosengaus |
| 5,566,402 | Agha el-Rifai et al. | 3,513,487 | Palermo |
| 5,384,919 | Smith | 3,462,766 | Merkel Jr. |
| 5,359,736 | Olivier | 3,430,268 | Zoberg |
| 5,287,566 | Azada | 3,425,066 | Berger |
| 5,272,774 | Ivko et al. | 3,386,105 | Martini |
| 5,271,104 | LaTora | 3,044,076 | Martini |
| 5,263,205 | Leunissen | 3,015,826 | Aranas |
| 5,247,711 | Kwon | 2,852,782 | Sundberg |
| 5,210,885 | Ruo | 2,722,014 | Bonomolo |
| 5,142,711 | Parikh | 2,600,619 | Contemo |
| 5,138,726 | Campbell | 1,962,014 | Guidetti |
| 5,090,067 | Cogdill | 1,960,839 | Campus |
| 5,063,618 | Souka | 1,874,169 | Campus |
| 4,926,509 | Bass | 1,787,481 | Kellogg |
| 4,924,534 | Basile | 1,752,782 | Burton |
| 4,691,391 | Kuo | 1,521,892 | Koppin |
| 4,642,820 | Boring Jr. | 1,455,905 | Cook |
| 4,596,058 | Nourbaskhsh | 1,117,353 | Engel |
| 4,360,934 | Ishigami et al. | 613,616 | Adee |
| 4,334,329 | Miyanaga | | |

SUMMARY OF INVENTION

The present invention relates generally to toilets and, to a toilet sanitary cleansing means whereby the user can wash the genitals and posterior parts of the body after the use of the toilet by means of separate nozzles.

A further object of the present invention is to provide a toilet sanitary cleansing means which is able to wash at least one of the genitals or posterior portions of a user's body by selectively using a dedicated cleaning nozzle.

A further object of the present invention is to provide a toilet sanitary cleansing means that can be used to clean posterior parts of the body after toilet use without the use of toilet paper through use of a drying function. This functionality is of particular importance far boat toilets and other toilets, where sanitary system cannot handle the processing of toilet paper.

A further object of the present invention is to provide a toilet sanitary cleansing means that has a self cleaning, disinfecting and deodorizing function for the nozzle itself. One method for achieving this object is by means of separate additive components.

A further objective of the present invention is to provide the means of mintaining completely clean and sanitary conditions far all users at all times. One method of achieving this object is by means of replaceable nozzles, and deodorizing, cleaning and disinfecting additives.

A further object of the present invention is to provide a toilet sanitary cleansing means that has a self cleaning, disinfecting and deodorizing function for the nozzle itself.

A further object of the present invention is to provide a toilet sanitary cleansing means that can be economically manufactured and is reliable in its operation.

A further objective of the present invention is to provide the means of maintaining completely clean and sanitary conditions for all users at all times.

Another object of the present invention is to provide a toilet sanitary cleansing means that is simple and easy to use.

Upon further study of the specification and appended claims, other objects, features and advantages of the present invention will become more fully apparent to those skilled in the art to which this invention pertains.

DETAILED DESCRIPTION

This invention overcomes numerous disadvantages and problems found within the prior art. The prior art can be classified into complex and simple devices. While such complex devices are typically very expensive to manufacture and such simple devices are relatively inexpensive to manufacture, there is a general lack of market acceptance for any of those devices which indicates additional problems. None of those devices requires a set of process conditions within which to operate them. None requires a projected cleaning area 13 within which cleaning of the genitals and posterior parts of the body can take place. None of the devices can be economically installed into all types of toilets, including flush tank and pressurized flush type toilets. None provides a device that operates with a cleaning fluid composed of multiple ingredients other than water. One means of providing said ingredients is by means of replaceable cartridges. None provides an environmentally friendly paperless toilet for use on boat toilets and other toilets operating in environmentally sensitive areas where sanitary system cannot handle the processing of toilet paper. A drying function is incorporated into the apparatus to achieve the paperless process. None defines a sanitary cleaning process for the device itself, whereby commercially available disinfectant and deodorizer fluids 16 are an integral part of the cleaning process. The detailed description of the preferred embodiments will address the aforementioned limitations and describe the solutions provided by the invention.

Figure 1:
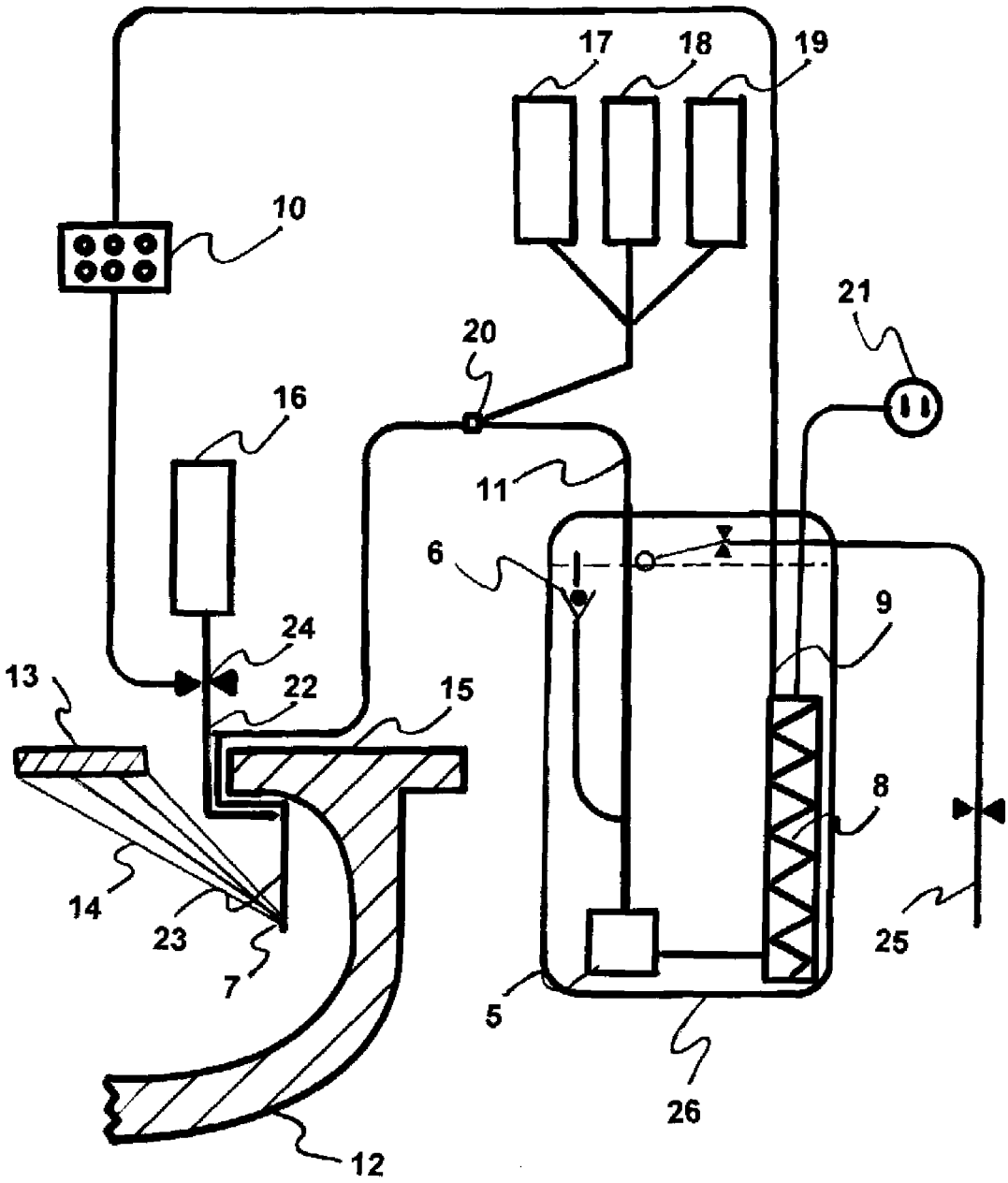
FIG. 1 is a schematic view of the components depicting the preferred embodiment of this invention.
Figure 2:
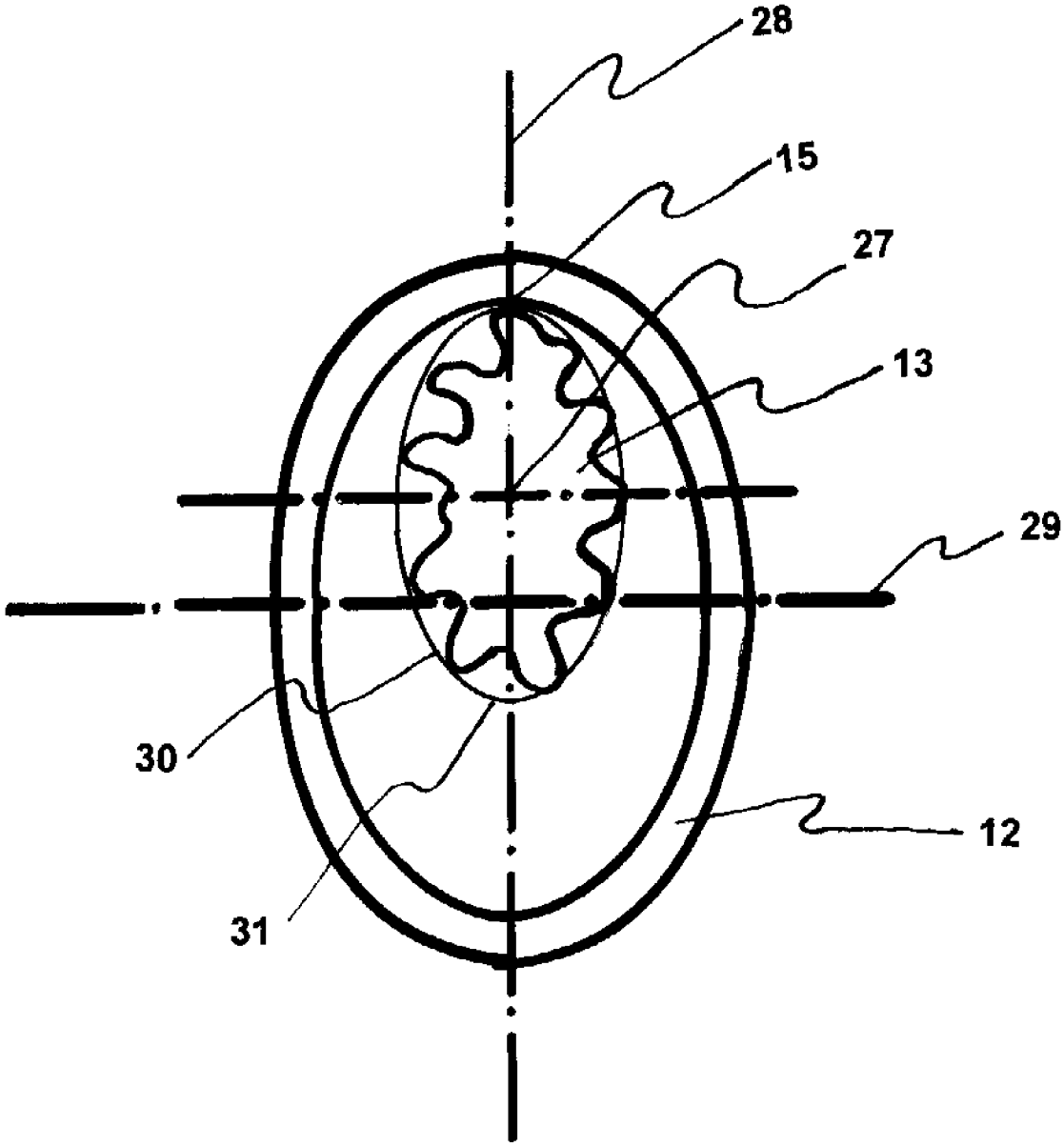
FIG. 2 is a top down view of a toilet bowl depicting the concept of a projected cleaning space in accordance with this invention.

The preferred embodiment, shown in FIG. 1, is one that uses an external cold water supply 25 and an external housing 26 containing a pump 5, a heater 8, an anti-siphon value 6, an electrical power source 21, a control wiring 21, and sufficient free volume to hold cleaning fluid. The said external housing 26 can be either foot mounted or wall mounted to fit the special requirements of its users. The external housing 26 embodiment is particularly well suited for high frequency use installations; the cleaning fluid storage volume and its internal components, such as the cleaning fluid pump 5 and the cleaning fluid heater, can be sized to fit virtually all needs from extremely high usage at public facilities to low usage private use facilities. This device can be installed into a boat in an environmentally friendly manner.

Said functional operating components located inside said external housing 26 consist of the following: A cleaning fluid pump 5 connected to a cleaning fluid pressure release valve 6, a means to pipe 11 said cleaning fluid to an externally located cleaning nozzle 7, and an electrical heater 8 that heats said cleaning fluid to a temperature ranging from 25° C. to 50° C. Also residing inside said external housing 26 is an electrical power 21 and a control wire connection 9 to said cleaning fluid pump 5 to and said electrical heater 8. A pressure sensitive switch installed under the toilet seat is used to prevent pump activation without the weight of a person sitting on the toilet. Said cleaning fluid pump 5 operates at a cleaning fluid pumping rate of 10 to 50 milliliters per second.

The operating duration of said cleaning fluid pump 5 is a) controlled by the user by means of an on/off switch 10 or b) set within the apparatus. The fluid rate is set by means of a mechanical or electrical controller within the said rate boundaries either set by the user during the use or set as a constant within the pump itself. The cleaning fluid temperature is set at the heater by controlling the rate of electrical power consumption or cleaning fluid temperature using either open loop or closed loop controllers.

A fluid pressure release valve 6, residing within the external housing 26, evacuates the cleaning fluid resident within the section from cleaning fluid pump 5 to cleaning nozzle 7 while providing three important functions. First, such valve interrupts the siphoning flow of the cleaning fluid after deactivating the cleaning fluid pump 5. Second, such valve provides a low level cleaning function for the contaminated cleaning nozzle 7. Third, such valve prevents cold cleaning fluid from being present at the beginning of next cleaning cycle.

A means, which pipes 11 cleaning fluid from the cleaning fluid pump 5 to a cleaning nozzle 7 mounted within the confines of a conventional toilet bowl 12, accommodates the cleaning fluid flow rates and cleaning fluid pressures and routes the cleaning fluid to the point of use, the cleaning nozzle 7. Said means to pipe 11 cleaning fluid is particularly configured for ease of installation and reliable operation.

Said cleaning nozzle 7 is mounted within the confines of a conventional toilet bowl 12 along its longitudinal axis at the back end of the toilet bowl 12 and below the rim of said toilet bowl 12. Said cleaning nozzle 7 is positioned within a well defined area defined by horizontal tolerance ranging from 30 to 150 millimeters below the rim of said toilet bowl 12 and vertical tolerance bound by plus/minus 80 millimeters from said longitudinal center line. Said cleaning nozzle 7 is mounted within 0 to 50 millimeters of the inner wall at the back end below the rim of said toilet bowl 12. Said nozzle is positioned in an upward angle that is defined by a projected cleaning space 13 and bound by an area created by the inside rim of said toilet bowl 12.

Said cleaning nozzle 7 creates a single diffused stream 14 of cleaning fluid directed toward said projected cleaning space 13 located within the confines of said toilet bowl 12; where, said projected cleaning space 13 is parallel to the area projected by the inside corner of the upper rim 15 of said toilet bowl 12, and said projected cleaning space 13 is centered in the rear half 27 of the toilet bowl 12 along the longitudinal center line 28 and segmented by the latitudinal center line 29 of the toilet bowl 12. Said projected cleaning space 13 is singular in any geometric shape 30 fitting within the confines of an oval 31, centered in the rear half along the longitudinal axis of any conventional toilet bowl 12, wherein said oval is bound in the rear end of the toilet bowl 12 by the toilet bowl 12 rim. The maximum width of said boundary projected cleaning space 13 oval is 150 millimeters while its maximum length is 200 millimeters.

Another variation of the said cleaning nozzle 7 is a specific cleaning cycle for the cleaning nozzle 7 itself. This cycle is achieved by piping and depositing a disinfectant and deodorizer 16 onto the outer nozzle's surfaces 23 after every use to ensure sanitary conditions for the subsequent user. This cleaning process is achieved through the use of a parallel piping conduit 22 that terminates at the upper end of the nozzle mount in a manner that assures complete coverage of the outer nozzle"s surfaces 23. The cleaning agent is located at the originating end of said conduit. A control circuit 24 automatically dispenses said cleaning agent after the nozzle is disengaged by the user. Readily commercially available toilet cleaning agents, such as DOW disinfectant bathroom cleaner, can be used as a cleaning agent for this purpose. The combination of a self-cleaning nozzle 7 and a disinfectant and deodorizer 16 will assure complete sanitary operation for every user.

Another embodiment of said cleaning nozzle 7 is one that creates a plurality of diffusing streams of cleaning fluid toward said projected cleaning space 13 of the various preferred geometric shapes.

A key feature of this invention is the definition of a set of process conditions for the various apparatuses. It is deemed very important to have said cleaning fluid expelled by said cleaning nozzle 7 at a specific flow rate and specific temperature. The preferred range of said cleaning fluid flow is from 10 to 50 milliliters per second at a temperature range from 25° C. to 50° C. The specific set point of both parameters are selected and set by the user according to personal preference. The apparatus has the capability of controlling both the flow rate and the temperature within reasonable tolerance limits.

Said cleaning fluid can consist of water only, water mixed with soap 17, water mixed with anti-bactericide 18, water mixed with anti-smelling agents 19 and any combination thereof. Those additives are added via injectors 20 in liquid form or slowly released into the cleaning water in solid form, or any other known method of adding water soluble components to said cleaning fluid. One means of providing said components is via replaceable cartridges.

While the present invention is described with reference to the preferred embodiments, it is in no way the intention to limit the invention to those embodiments but rather to include all modification, alterations and equivalent possible arrangements within the scope of the appended claims.

The invention claimed is:

1. A posterior pan cleansing apparatus consisting of the following components:

a. A piping connection from a cold water source to an external housing, b. An electrical power source connected to said external housing, d. Said external housing using containing the following components:

i. An internal cleaning fluid housing, ii. A cleaning fluid level controlling valve to maintain the water level within said internal cleaning fluid housing, iii. A cleaning fluid pump, iv. A means to interrupt the cleaning fluid flow after deactivation of said fluid pump, v. A fluid heater, vi. An electric power source that provides power to both said heater and pump, e. A means to control duration of pump activation;

f. A cleaning nozzle mounted within the confines of any conventional toilet bowl;

g. A means to pipe the cleaning fluid to a cleaning nozzle;

h. Said cleaning nozzle creating a diffused stream of cleaning fluid to a specific projected cleaning space located within the confines of the toilet bowl where;

i. Said projected cleaning space is parallel to the area projected by the upper rim of the toilet bowl, ii. Said projected cleaning space is centered in the rear half of the toilet bowl along the longitudinal center line and segmented by the latitudinal center line of the toilet bowl, iii. Said projected cleaning space upper area is planar in any geometric shape fitting within the confines of an oval area, centered in the rear half along the longitudinal axis of any conventional toilet bowl, where said oval area has a maximum width of 150 millimeters and a maximum length of 200 millimeters, and said oval area is bound in the rear end of said toilet bowl by the inner rim of said toilet bowl.

iv. Said projected cleaning space has a height protruding into the toilet bowl of up to 100 millimeters.

2. A posterior part cleansing apparatus specified in claim 1, where the cleaning nozzle creates a plurality of steams of cleaning fluid toward the projected cleaning space.

3. A posterior part cleansing apparatus specified in claim 1, where a pressure sensitive switch is located under the seat of any conventional toilet bowl.

4. A posterior part cleansing apparatus specified in claim 2, where a pressure sensitive switch is located under the seat of any conventional toilet bowl.

5. A posterior part cleansing apparatus specified in claim 1, where the cleaning nozzle has a sanitary cleaning cycle after every use wherein a disinfectant and/or deodorizer is deposited onto the exposed nozzle surfaces.

6. A posterior part cleansing apparatus specified in claim 2, where the cleaning nozzle has a sanitary cleaning cycle after every use wherein a disinfectant and deodorizer is deposited onto the exposed nozzle surfaces.

7. A posterior part cleansing apparatus specified in claim 1, where said cleaning nozzle is mounted along the longitudinal axis at the back end of any conventional toilet bowl with a vertical tolerance from the center line of plus or minus 100 millimeters, and said cleaning nozzle is positioned below the upper edge of the rim of said toilet bowl within the toilet bowl in a horizontal tolerance range from 0 to 150 millimeters and Within 0 to 100 millimeters of the inner wall of said toilet bowl.

8. A posterior part cleansing apparatus specified in claim 2, where said cleaning nozzle is mounted along the longitudinal axis at the back end of any conventional toilet bowl with a vertical tolerance from the center line of plus or minus 100 millimeters, and said cleaning nozzle is Positioned below the upper edge of the rim of said toilet bowl within the toilet bowl in a horizontal tolerance range from 0 to 150 millimeters and within 0 to millimeters of the inner wall of said toilet bowl.

9. A process employing a posterior part cleansing apparatus specified in one of claim 1, where cleaning fluid is provided to the projected cleaning space at a rate ranging from 10 to 50 milliliters per second and at a temperature ranging from 25 to 50 degree centigrade.

10. A process employing a posterior part cleansing apparatus specified in claim 2, where cleaning fluid is provided to the projected cleaning space at a rate ranging from 10 to 50 milliliters per second at a temperature ranging from 25 to 50 degree centigrade.

11. A process employing a posterior part cleansing apparatus specified in one of claim 1, where the cleaning fluid is provided to the projected cleaning space at a rate ranging from 10 to 50 milliliters per second, at a temperature ranging from 25 to 50 degree centigrade, and at a nozzle exit velocity ranging from 4 to 6 meters per second.

12. A process employing a posterior part cleansing apparatus specified in claim 2, where the cleaning fluid is provided to the projected cleaning space at a rate ranging from 10 to 50 milliliters per second, at a temperature ranging from 25 to 50 degree centigrade, and at a nozzle exit velocity ranging from 4 to 6 meters per second.

13. A process employing a posterior part cleansing apparatus specified in claim 1, where cleaning fluid is provided to the projected cleaning space at a rate ranging from 10 to 50 milliliters per second and at a temperature ranging from 25 to 50 degree centigrade, and a disinfectant and deodorizer is deposited onto the exposed nozzle surfaces for a period ranging from 0.5 to 10 seconds at the end of every cleaning cycle.

14. A process employing a posterior part cleansing apparatus specified in claim 2, where cleaning fluid is provided to the projected cleaning space at a rate ranging from 10 to 50 milliliters per second and at a temperature ranging from 25 to 50 degree centigrade, and a disinfectant and deodorizer is deposited onto the exposed nozzle surfaces for a period ranging from 0.5 to 10 seconds at the end of every cleaning cycle.

15. A process employing a posterior part cleansing apparatus specified in claim 1, where the cleaning fluid is water.

16. A process employing a posterior part cleansing apparatus specified in claim 2, where the cleaning fluid is water.

17. A process employing a posterior part cleansing apparatus specified in one claim 1, where the cleaning fluid is a mixture of soap and water.

18. A process employing a posterior part cleansing apparatus specified in claim 2, where the cleaning fluid is a mixture of soap and water.

19. A process employing a posterior part cleansing apparatus specified in claim 1, where the cleaning fluid is a mixture of water, anti-bactericides and soap.

20. A process employing a posterior part cleansing apparatus specified in claim 2, where the cleaning fluid is a mixture of water, anti-bactericides and soap.

21. A process employing a posterior part cleansing apparatus specified in one-of claim 1, where the cleaning fluid is a mixture of water, anti-bactericides, anti-smelling agents and soap.

22. A process employing a posterior part cleansing apparatus specified in claim 2, where the cleaning fluid is a mixture of water, anti-bactericides, anti-smelling agents and soap.

23. A process employing a posterior part cleansing apparatus specified in one-of claim 1, where the duration of the cleaning cycle is automatically time controlled.

24. A process employing a posterior part cleansing apparatus specified in claim 2, where the duration of the cleaning cycle is automatically time controlled.

25. A process employing a posterior part cleansing apparatus specified in claim 1, where the duration of the cleaning cycle is manually time controlled.

26. A process employing a posterior part cleansing apparatus specified in claim 2, where the duration of the cleaning cycle is manually time controlled.

27. A process employing a posterior part cleansing apparatus specified in claim 1, where the rate of cleaning fluid is controllable within a range of 10 to 50 milliliters per second.

28. A process employing a posterior part cleansing apparatus specified in claim 2, where the rate of cleaning fluid is controllable within a range of 10 to 50 milliliters per second.

29. A process employing a posterior part cleansing apparatus specified in claim 1, where the temperature of the cleaning fluid is controllable within a range of 15 to 50 degrees centigrade.

30. A process employing a posterior part cleansing apparatus specified in claim 2, where the temperature of the cleaning fluid is controllable within a range of 15 to 50 degrees centigrade.

31. A process employing a posterior part cleansing apparatus specified in claim 1, where the rate of cleaning fluid is controllable within a range of 10 to 50 milliliters per second, and where the temperature of the cleaning fluid is controllable within a range of 30 to 50 degrees centigrade.

32. A process employing a posterior part cleansing apparatus specified in claim 2, where the rate of cleaning fluid is controllable within a range of 10 to 50 milliliters per second, and where the temperature of the cleaning fluid is controllable within a range of 30 to 50 degrees centigrade.

33. A posterior part cleansing apparatus specified in claim 1, where the cleaning nozzle creates a single of stream of cleaning fluid toward the projected cleaning space.

34. An apparatus specified in claim 1, where a bidet function is provided through a second cleaning nozzle assembly.

35. An apparatus specified in claim 34, where the said external housing is mountable to any conventional toilet bowl as a replacement of a conventional toilet seat and lid assembly.

36. An apparatus specified in claim 35, where a post posterior part cleansing air drying function is incorporated within said external housing.

37. An apparatus specified in claim 36, where a plenum chamber uniformly distributes heated air to multiple points of use within said external housing.

38. An apparatus specified in claim 36, where the air drying function is automatically activated.

39. An apparatus specified in claim 36, where the air drying function is manually activated.

40. An apparatus specified in claim 36, where the drying air temperature and volume is user selectable.

41. An apparatus specified in claim 36, where a replaceable air freshener cartridge is incorporated into the said air drying function.

42. An apparatus specified in claim 35, where the external material include anti-bacterial polymer components.

43. An apparatus specified in claim 42, where a hand sprayer assembly consisting of a connection to a cleaning fluid source, a cleaning fluid hose, a dispensing spray nozzle, a manually activated on/off valve are attached to said external housing.

44. An apparatus specified in claim 43, where the band sprayer is an attachment to said external housing via quick disconnect.

45. An apparatus specified in claim 44, where the hand sprayer is an integral part of said housing.

46. An apparatus specified in claim 35, where a small portion of the cleaning fluid is diverted to several diffusing cleaning fluid outlets for the purposes of cleaning exposed apparatus surfaces, while operating said posterior part cleansing nozzles.

47. An apparatus specified in claim 46, where said diffusing cleaning fluid outlets are positioned such that the resulting cleaning fluid flaw is along the axis of the moveable portion of the posterior part cleansing nozzle assembly.

48. An apparatus specified in claim 35 where an apparatus cleaner cartridge is integrated into the external housing and utilized in a post use apparatus cleaning cycle.

49. An apparatus specified in claim 35, where the moveable portion of the posterior part cleansing nozzle housing is mechanically cleaned during its retraction movement.

50. An apparatus specified in claim 35, where the cleaning nozzle is replaceable and contains different orifice sizes and orifice shapes.

51. An apparatus specified in claim 50, where the cleaning nozzle is color coded.

52. An apparatus specified in claim 51, where the cleaning nozzle connection is indexed and a push-in type.

53. An apparatus specified in claim 35, where the cleaning nozzle is retractable to a non-use position.

54. An apparatus specified in claim 35, where the cleaning nozzle movement into an operating position is cleaning fluid pressure activated.

55. An apparatus specified in claim 35, where the cleaning nozzle movement into an operating position is solenoid activated.

56. An apparatus specified in claim 35, where the cleaning nozzle movement into an operating position is mechanically activated.

57. A process employing a posterior part cleansing apparatus specified in claim 35, where the cleaning fluid is water.

58. A process employing a posterior part cleansing apparatus specified in claim 35, where the cleaning fluid is a mixture of soap and water.

59. A process employing a posterior part cleansing apparatus specified in claim 35, where the cleaning fluid is a mixture of water, anti-bactericides and soap.

60. A process employing a posterior part cleansing apparatus specified in claim 35, where the cleaning fluid is a mixture of water, anti-bactericides, anti-smelling agents and soap.

* * * * *